US006797679B2

(12) United States Patent
Kawasaki et al.

(10) Patent No.: US 6,797,679 B2
(45) Date of Patent: Sep. 28, 2004

(54) LUBRICANT COMPOSITION

(75) Inventors: Hiroshi Kawasaki, Ichihara (JP); Nobuaki Watanabe, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 10/315,119

(22) Filed: Dec. 10, 2002

(65) Prior Publication Data

US 2003/0158050 A1 Aug. 21, 2003

(30) Foreign Application Priority Data

Dec. 10, 2001 (JP) ..... 2001-375936

(51) Int. Cl.[7] ..... C10M 141/10

(52) U.S. Cl. ..... 508/272; 508/338; 508/429; 508/433; 508/436; 508/438; 508/569

(58) Field of Search ..... 508/272, 429, 508/273

(56) References Cited

U.S. PATENT DOCUMENTS 4,001,129 A * 1/1977 Sheratte ..... 252/78.5
4,118,328 A * 10/1978 Hotten ..... 508/436
5,094,763 A * 3/1992 Tochigi et al. ..... 508/273
5,422,023 A * 6/1995 Francisco ..... 508/273
5,552,068 A * 9/1996 Griffith ..... 508/436
6,030,543 A * 2/2000 Placek et al. ..... 252/78.5
6,165,950 A * 12/2000 Rao et al. ..... 508/433
6,399,548 B1 * 6/2002 Vartanian et al. ..... 508/273
6,613,722 B1 * 9/2003 Watts et al. ..... 508/195

* cited by examiner

*Primary Examiner*—Ellen M McAvoy
(74) *Attorney, Agent, or Firm*—Oblon, Spivak, McClelland, Maier & Neustadt, P.C.

(57) ABSTRACT

Provided is a lubricant composition prepared by adding, to a base oil, (a) from 0.01 to 5% by mass, based on the composition, of a phosphate, (b) from 0.005 to 1% by mass of an amine salt of an acid phosphate and (c) from 0.01 to 1% by mass of a sulfur-containing extreme-pressure agent. The composition is favorable for non-zinc hydraulic oil, which has good oxidation resistance, sludge resistance and wear resistance and further has improved extreme pressure resistance and prolonged fatigue life.

17 Claims, No Drawings

LUBRICANT COMPOSITION

BACKGROUND OF THE INVENTION

1. Field of the Invention

The present invention relates to a lubricant composition, more precisely, to that favorable for hydraulic oil to be used for power transmission in construction equipment, machine tools, etc.

2. Description of the Related Art

Regarding its history, hydraulic oil has developed from zinc-containing oil into long-life zinc-containing oil and now into non-zinc oil. Non-zinc oil has good oxidation resistance, sludge resistance and wear resistance but is defective in that its extreme pressure resistance and fatigue life are inferior in some degree to those of zinc-containing oil. Therefore desired is non-zinc hydraulic oil which has its own advantages of good oxidation resistance, sludge resistance and wear resistance and further has improved extreme pressure resistance and prolonged fatigue life. JP-A 9-111277, 2000-303086 and 2000-169871 disclose typical examples of non-zinc hydraulic oil that contains a phosphate such as typically tricresyl phosphate. However, the phosphate is defective in that it often causes seizure and serious wearing of hydraulic tools that are driven under high pressure especially under 30 MPa or higher.

SUMMARY OF THE INVENTION

From the viewpoint noted above, we, the inventors have made the present invention. The invention is to provide a lubricant composition favorable for non-zinc hydraulic oil, which has good oxidation resistance, sludge resistance and wear resistance and further has improved extreme pressure resistance and prolonged fatigue life.

We, the present inventors have assiduously studied and, as a result, have found that the object of the invention can be effectively attained by using additives of a phosphate, an amine salt of an acid phosphate, and a sulfur-containing extreme-pressure agent. On the basis of this finding, we have completed the present invention.

Specifically, the subject matter of the invention includes the following:

1. A lubricant composition prepared by adding, to abase oil, (a) from 0.01 to 5% by mass, based on the composition, of a phosphate, (b) from 0.005 to 1% by mass of an amine salt of an acid phosphate and (c) from 0.01 to 1% by mass of a sulfur-containing extreme-pressure agent.
2. The lubricant composition of above 1, wherein the sulfur-containing extreme-pressure agent is a thiadiazole compound.
3. The lubricant composition of above 1 or 2, wherein the phosphate is tricresyl phosphate.
4. The lubricant composition of any of above 1 to 3, wherein the amine salt of an acid phosphate is dodecylamine salt of acid mono(di)-methyl phosphate.
5. The lubricant composition of any of above 1 to 4, which is used for hydraulic oil.

DESCRIPTION OF THE PREFERRED EMBODIMENTS

The invention is described in detail hereinunder.

For the base oil to be in the lubricant composition of the invention, used are mineral oil and/or synthetic oil. The mineral oil and the synthetic oil for use herein may be any ordinary ones generally used for the base oil for lubricant oil, preferably for the base oil for hydraulic oil, and are not specifically defined. Preferably, however, the base oil to be in the lubricant composition of the invention has a kinematic viscosity at 40° C. of from 3 to 460 $mm^2$/sec, more preferably from 5 to 250 $mm^2$/sec. Base oil having too high kinematic viscosity is not preferred since it may worsen the low-temperature characteristics of the composition that contains it. Contrary to this, base oil having too low kinematic-viscosity is also not preferred, since it could not form satisfactory oil film. Also preferably, the value of % $C_A$ of the base oil for use herein is at most 10, more preferably at most 5 from the viewpoint of good oxidation resistance. The pour point of the base oil, indicating the low-temperature flowability thereof, is not specifically defined, but is preferably not higher than −10° C., more preferably not higher than −15° C. The viscosity index of the base oil is preferably at least 95 for keeping high the viscosity thereof at high temperatures.

Various types of mineral oil and synthetic oil are available, and they may be suitably selected for the base oil to be in the lubricant composition of the invention in accordance with the use of the composition. Mineral oil usable herein includes, for example, paraffinic mineral oil, naphthenic mineral oil and intermediate mineral oil. Concretely, they are solvent-purified or hydrogenation-purified light neutral oil, medium-gravity neutral oil, heavy neutral oil, bright stock, etc. Of those, preferred are light neutral oil and medium-gravity neutral oil.

Synthetic oil also usable herein includes, for example, poly-α-olefins (PAOs), α-olefin copolymers, polybutenes, alkylbenzenes, polyol esters, dibasic acid esters, polyoxyalkylene glycols, polyoxyalkylene glycol esters, polyoxyalkylene glycol ethers, hindered esters, silicone oils, etc. Of those, preferred are PAOs and α-olefin copolymers.

Either singly or as combined, one or more such base oils may be in the composition of the invention. If desired, mineral oil may be combined with synthetic oil for use herein.

The components (a), (b) and (c) that are added to the base oil are described below.

Component (a)

The component (a) to be in the lubricant composition of the invention is a phosphate represented by the following general formula (1):

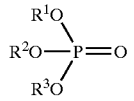

(1)

wherein $R^1$ to $R^3$ each represent an alkyl group having from 1 to 30 carbon atoms, an alkenyl group having from 2 to 30 carbon atoms, or an aryl group having from 6 to 30 carbon atoms, and $R^1$ to $R^3$ may be the same or different.

Concretely, for example, the phosphate includes tributyl phosphate, ethyldibutyl phosphate, trihexyl phosphate, tri (2-ethylhexyl) phosphate, tridecyl phosphate, trilauryl phosphate, trimyristyl phosphate, tripalmityl phosphate, tristearyl phosphate, trioleyl phosphate and tricresyl phosphate. Of those, preferred is tricresyl phosphate.

The amount of the component (a) to be added to the base oil falls between 0.01 and 5% by mass of the composition. If it is smaller than 0.01% by mass, the wear-resisting effect of the composition is unsatisfactory; but even if larger than 5% by weight, the effect will not increase anymore. Preferably, the content of the component (a) falls between 0.1 and 3% by mass.

Component (b)

The component (b) to be in the lubricant composition of the invention is an amine salt of an acid phosphate, and the acid phosphate for it is represented by the following general formula (2) or (3):

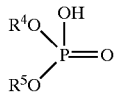

(2)

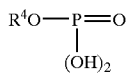

(3)

wherein $R^4$ and $R^5$ each represent an alkyl group having from 1 to 30 carbon atoms, including, for example, methyl, ethyl, n-propyl, isopropyl, n-butyl, isobutyl, s-butyl and t-butyl groups; and all types of pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, dococyl, tricosyl, tetracosyl, pentacosyl, hexacosyl, heptacosyl, octacosyl, nonacosyl and triacontyl groups. $R^4$ and $R^5$ may be the same or different. Especially preferably, they are both methyl groups.

The amine to form the amine salt with the acid phosphate includes, for example, mono-substituted amines (primary amines), di-substituted amines (secondary amines) and tri-substituted amines (tertiary amines) of the following general formula (4):

$$R_6''NH_{3-n} \quad (4)$$

wherein $R^6$ represents an alkyl group having from 1 to 30 carbon atoms; n indicates 1, 2 or 3; and $R^6$'s, if any, may be the same or different.

The alkyl group having from 1 to 30 carbon atoms for $R^6$ in formula (4) may be linear or branched, like that for $R^4$ and $R_5$ mentioned above. Above all, especially preferred are dodecyl-substituted primary amine.

The amount of the component (b) to be added to the base oil falls between 0.005 and 1% by mass of the composition. If it is smaller than 0.005% by mass, the extreme-pressure effect of the composition is unsatisfactory; but even if larger than 1% by weight, the effect will not increase anymore. Preferably, the content of the component (b) falls between 0.01 and 0.7% by mass.

Component (c)

Containing sulfur atom(s) in the molecule, the component (c), sulfur-containing extreme-pressure agent to be in the lubricant composition of the invention is not specifically defined so far as it can dissolve or uniformly disperse in the base oil and can exhibit the extreme-pressure effect. It includes, for example, sulfurized oils and fats, sulfurized fatty acids, sulfurized esters, sulfurized olefins, dihydrocarbyl polysulfides, thiocarbamates, thioterpenes, dialkylthio dipropionates, and thiadiazoles. The sulfurized oils and fats are obtained by reacting oils and fats (e.g., lard oil, whale oil, vegetable oil, fish oil) with sulfur or a sulfur-containing compound, and their sulfur content is not specifically defined. In general, however, preferred are those having a sulfur content of from 5 to 30% by mass. Their specific examples are sulfurized lard, sulfurized rapeseed oil, sulfurized castor oil, sulfurized soybean oil, and sulfurized rice bran oil. One example of the sulfurized fatty acids is sulfurized oleic acid; and examples of the sulfurized esters are sulfurized methyl oleate, and sulfurized octyl esters of rice bran fatty acids.

The sulfurized olefins include, for example, compounds of the following general formula (5):

$$R^7—S_x—R^8 \quad (5)$$

wherein $R^7$represents an alkenyl group having from 2 to 15 carbon atoms; $R^8$ represents an alkyl or alkenyl group having from 2 to 15 carbon atoms; and x indicates an integer of from 1 to 8.

The compounds are obtained by reacting an olefin having from 2 to 15 carbon atoms or its di- to tetra-mer with a sulfurizing agent such as sulfur or sulfur chloride. As the olefin, preferred are propylene, isobutene and diisobutene.

The dihydrocarbyl polysulfides are compounds of the following general formula (6):

$$R^9—S_y—R^{10} \quad (6)$$

wherein $R^9$ and $R^{10}$ each represent an alkyl group having from 1 to 20 carbon atoms, a cyclic alkyl group having from 3 to 20 carbon atoms, an aryl group having from 6 to 20 carbon atoms, an alkylaryl group having from 7 to 20 carbon atoms, or an arylalkyl group having from 7 to 20 carbon atoms, and they may be the same or different; and y indicates an integer of from 2 to 8.

The compounds of formula (6) where $R^9$ and $R^{10}$ are alkyl groups are referred to as alkyl sulfides.

Specific examples of $R^9$ and $R^{10}$ in formula (6) include methyl, ethyl, n-propyl, isopropyl, n-butyl, isobutyl, sec-butyl and tert-butyl groups; all types of pentyl, hexyl, heptyl, octyl, nonyl, decyl and dodecyl groups; and cyclohexyl, cyclooctyl, phenyl, naphthyl, tolyl, xylyl, benzyl and phenethyl groups.

As preferred examples of the dihydrocarbyl polysulfides, mentioned are dibenzyl polysulfide, di-tert-nonyl polysulfide, didodecyl polysulfide, di-tert-butyl polysulfide, dioctyl polysulfide, diphenyl polysulfide and dicyclohexyl polysulfide.

The thiocarbamates include, for example, zinc dithiocarbamate. The thioterpenes include, for example, reaction products of phosphorus pentasulfide and pinene. The dialkylthio dipropionates include, for example, dilaurylthio dipropionate and distearylthio dipropionate.

For the component (c), most preferred are thiadiazoles of, for example, the following general formula (7):

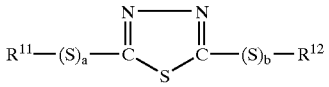

(7)

wherein $R^{11}$ represents an alkyl group having from 1 to 30 carbon atoms, which may be linear or branched like $R^4$ and $R^5$ mentioned above, and preferably, it is an alkyl group having from 6 to 20 carbon atoms; $R^{12}$represents a hydrogen atom or an alkyl group having from 1 to 30 carbon atoms, the alkyl group for it may be linear or branched like $R^4$ and $R^5$ mentioned above, and preferably, it is a hydrogen atom or an alkyl group having from 6 to 20 carbon atoms; a and b each independently indicate a number of from 1 to 3, but preferably 1 or 2.

Of the thiadiazole compounds of formula (7), especially preferred is 2,5-bis(1,1,3,3-tetramethylbutanedithio)-1,3,4-thiadiazole.

The amount of the component (c) to be added to the base oil falls between 0.01 and 1% by mass of the composition.

If it is smaller than 0.01% by mass, the extreme-pressure effect of the composition is unsatisfactory; but even if larger than 1% by weight, the effect will not increase anymore. Preferably, the content of the component (c) falls between 0.01 and 0.7% by mass.

The kinematic viscosity at 40° C. of the lubricant composition of the invention preferably falls between 5 and 250 $mm^2$/sec; and the total acid value thereof (according to indicator method) preferably falls between 0.01 and 0.5 mg KOH/g.

The lubricant composition of the invention is obtained by adding the components (a), (b) and (c) to base oil. In general, various known additives that have the ability to improve the properties of lubricant may be added to the composition, not interfering with the object of the invention. Examples of the additives are antioxidant (except zinc dithiophosphate), rust inhibitor, oil improver, viscosity index improver, pour point depressant and defoaming agent. The amount of the optional additives that may be in the composition preferably falls between 0.05 and 25% by mass of the composition.

The lubricant composition of the invention is especially favorable for hydraulic oil for injection-molding machines, machine tools, construction equipment, iron-manufacturing equipment, etc. In addition, it is also favorable for hydraulic oil for other hydraulic systems, for example, for industrial robots and hydraulic elevators.

EXAMPLES

The invention is described in more detail with reference to the following Examples, which, however, are not intended to restrict the scope of the invention.

Examples 1 to 5

Comparative Examples 1 to 4

The components shown in Table 1 below were added to base oil in the ratio indicated therein to prepare lubricant compositions of Examples and Comparative Examples. These compositions were tested for their working capabilities as hydraulic oil under the conditions mentioned below. The test data are given in Table 1.

(1) Heat Resistance <1>

The amount of sludge formed and the total acid value of the sample oil tested are measured according to the lubricant oxidation stability test for internal combustion engines (ISOT) of JIS K 2514-1996.

Test Condition

Temperature: 165.5° C.

Test Time: 48 hours (2) Heat Resistance <2>

Using a high-pressure circulation test device (pump, UCHIDA-REXROTH A2F0; pump pressure, 35 MPa; sample oil temperature, 80°; air intake, 10 NL/hr; see *Monthly Tribology*, October 2001, page 47), the sample oil is tested for accelerated oxidation. After 1000 hours, the amount of sludge formed and the total acid value of the sample oil tested are measured.

In (1) and (2), the amount of sludge formed is measured as follows: A predetermined amount of the sample oil is filtered through a membrane filter having a pore size of 0.8 μm. Before used, the weight of the fresh membrane filter is previously measured. After used, the filter is washed and dried, and its weight is again measured. The weight increase in the filter indicates the amount of sludge formed in the sample oil.

(3) Wear Resistance <1>

According to the lubricant oil wear resistance test (Shell four-ball test) of JPI-5S-32-1990, the wear trace of the test steels fixed in the sample container that contains the sample oil therein is measured.

Test Condition

Number of Revolution: 1200 rpm

Load: 294 N

Temperature: 50° C.

Test Time: 30 minutes (4) Wear Resistance <2>

Lubricated with the sample oil, a pump is driven under a predetermined condition and tested by a vane pump test according to the Vickers method. The wear loss of the vane and the cam ring is measured.

Test Condition

Pump Type: Vickers Vane V104C

Pump Pressure: 14 MPa

Pump Revolution: 1200 rpm

Oil Temperature: 65° C.

Test Time: 250 hours (5) Extreme-pressure Property

According to the FZG scuffing test of ASTM D-5182, the stage of the seizure load is measured.

(6) Fatigue Life

Using a high-speed high-bearing fatigue tester (Shinko Zoki's angular ball bearing fatigue tester), the fatigue life-prolonging effect of the sample oil is derived from the bearing fatigue life measured.

Test Condition

Bearing Pressure: 3.78 GPa

Number of Revolution: 1800 rpm

Oil Temperature: 100° C.

The sample oil is filled into 6 testers, and the testers are started all at a time under the predetermined condition. The time taken by each tester before it reaches its vibration limit is recorded, and this is the life of each tester. Six data are plotted for Weibull distribution, and the 10% failure probability $L_{10}$ (hr) and the 50% failure probability $L_{50}$ (hr) of the sample oil are derived from the approximate line

TABLE 1-1

| | | Example 1 | Example 2 | Example 3 | Example 4 | Example 5 |
|---|---|---|---|---|---|---|
| Composition Formulation (mass %) | base oil *1 | balance | balance | balance | balance | balance |
| | phosphate *2 | 0.5 | 0.6 | 0.7 | 0.8 | 0.9 |
| | amine salt of phosphate *3 | 0.05 | 0.04 | 0.03 | 0.02 | 0.01 |
| | sulfur-containing extreme-pressure agent *4 | 0.1 | 0.08 | 0.12 | 0.06 | 0.06 |
| | zinc dithiophosphate | — | — | — | — | — |
| Kinematic Viscosity of Composition (40° C.), $mm^2$/sec | | 30.39 | 45.65 | 22.58 | 32.40 | 68.24 |
| Total Acid Value (indicator method), mg KOH/g | | 0.15 | 0.15 | 0.12 | 0.15 | 0.14 |
| Heat Resistance <1> | Amount of Sludge Formed mg/100 ml | 1 | 3 | 5 | 4 | 3 |
| | Total Acid Value Increase mg KOH/g | 0.00 | 0.00 | 0.00 | 0.00 | 0.00 |
| Heat Resistance <2> | Amount of Sludge Formed mg/100 ml | 1 | 6 | 3 | 5 | 7 |

TABLE 1-1-continued

| | | Example 1 | Example 2 | Example 3 | Example 4 | Example 5 |
|---|---|---|---|---|---|---|
| | Total Acid Value Increase mg KOH/g | 0.14 | 0.07 | 0.05 | 0.06 | 0.09 |
| Wear Resistance <1> | Shell four-ball test, mm | 0.32 | 0.40 | 0.40 | 0.43 | 0.40 |
| Wear Resistance <2> | Vane pump test, mg | 30 | 7 | 9 | 8 | 5 |
| Extreme-pressure Property | FZG scuffing, stage | 10 | 12< | 12< | 12< | 12< |
| Fatigue Test | $L_{10}$, hr | 24 | 26 | 22 | 25 | 37 |
| | $L_{50}$, hr | 105 | 119 | 110 | 116 | 144 |

TABLE 1-2

| | | Comp. Ex. 1 | Comp. Ex. 2 | Comp. Ex. 3 | Comp. Ex. 4 |
|---|---|---|---|---|---|
| Composition | base oil *1 | balance | balance | balance | balance |
| Formulation | phosphate *2 | — | 0.7 | 0.8 | — |
| (mass %) | amine salt of phosphate *3 | 0.03 | — | 0.02 | — |
| | sulfur-containing extreme-pressure agent *4 | 0.06 | 0.08 | — | — |
| | zinc dithiophosphate | — | — | — | 0.7 |
| Kinematic Viscosity of Composition (40° C.), $mm^2$/sec | | 30.21 | 30.36 | 30.32 | 45.71 |
| Total Acid Value (indicator method), mg KOH/g | | 0.15 | 0.09 | 0.13 | 0.79 |
| Heat Resistance <1> | Amount of Sludge Formed mg/100 ml | 5 | 3 | 2 | 190 |
| | Total Acid Value Increase mg KOH/g | 0.00 | 0.00 | 0.00 | 0.01 |
| Heat Resistance <2> | Amount of Sludge Formed mg/100 ml | 11 | 8 | 9 | 22 |
| | Total Acid Value Increase mg KOH/g | 0.10 | 0.09 | 0.12 | 0.57 |
| Wear Resistance <1> | Shell four-ball test, mm | 0.61 | 0.45 | 0.41 | 0.44 |
| Wear Resistance <2> | Vane pump test, mg | 127 | 41 | 46 | 65 |
| Extreme-pressure Property | FZG scuffing, stage | 7 | 9 | 8 | 12 |
| Fatigue Test | $L_{10}$, hr | 5 | 3 | 6 | 7 |
| | $L_{50}$, hr | 22 | 64 | 73 | 26 |

(Notes)

*1: In Example 1 and Comparative Examples 1 to 4, this is paraffinic mineral oil purified through hydrogenation purification (having a kinematic viscosity at 40° C. of 26.76 $mm^2$/sec).

In Example 2, this is paraffinic mineral oil purified through hydrogenation purification (having a kinematic viscosity at 40° C. of 45.50 $mm^2$/sec).

In Example 3, this is paraffinic mineral oil purified through hydrogenation purification (having a kinematic viscosity at 40° C. of 21.78 $mm^2$/sec).

In Example 4, this is paraffinic mineral oil purified through hydrogenation purification (having a kinematic viscosity at 40° C. of 32.85 $mm^2$/sec).

In Example 5, this is paraffinic mineral oil purified through hydrogenation purification (having a kinematic viscosity at 40° C. of 67.85 $mm^2$/sec).

*2: This is tricresyl phosphate.

*3: This is dodecylamine salt of acid mono(di)-methyl phosphate.

*4: This is 2,5-bis(1,1,3,3-tetramethylbutanedithio)-1,3,4-thiadiazole.

As described in detail hereinabove with reference to its preferred embodiment, the invention provides a lubricant composition favorable for non-zinc hydraulic oil, which has good oxidation resistance, sludge resistance and wear resistance and further has improved extreme pressure resistance and prolonged fatigue life.

What is claimed is:

1. A lubricant composition prepared by adding, to a base oil, (a) from 0.01 to 5% by weight, based on the composition, of a phosphate, (b) from 0.005 to 1% by weight of an amine salt of an acid phosphate, and (c) from 0.01 to 1% by weight of a sulfur-containing extreme-pressure agent.

2. The lubricant composition as claimed in claim 1, wherein the sulfur-containing extreme-pressure agent is a thiadiazole compound.

3. The lubricant composition as claimed in claim 1 or 2, wherein the the phosphate is tricresyl phosphate.

4. The lubricant composition as claimed in claim 1 or 2, wherein the amine salt of an acid phosphate is dodecylamine salt of acid mono(di)-methyl phosphate.

5. A hydraulic oil which is the lubricant composition according to claim 1.

6. The lubricant composition as claimed in claim 1, wherein the base oil has a kinematic viscosity at 40° C. of 3 to 460 $mm^2$/sec.

7. The lubricant composition as claimed in claim 1, wherein the base oil is a mineral or synthetic oil.

8. The lubricant composition as claimed in claim 1, wherein the phosphate has the formula:

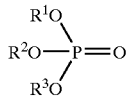

wherein $R^1$ to $R^3$, which may be the same or different, each represent $C_{1-30}$-alkyl, $C_{2-30}$-alkenyl or $C_{6-30}$-aryl.

9. The lubricant composition as claimed in claim 8, wherein the phosphate is selected from the group consisting of tributyl phosphate, ethyldibutyl phosphate, trihexyl phosphate, tri(2-ethylhexyl) phosphate, tridecyl phosphate, trihexyl phosphate, trilauryl phosphate, trimyristyl phosphate, tripalmityl phosphate, tristearyl phosphate, trioleyl phosphate and tricresyl phosphate.

10. The lubricant composition as claimed in claim 1, wherein the phosphate component (a) is present in an amount of 0.1 to 3% by wt.

11. The lubricant composition as claimed in claim 1, wherein the acid phosphate has formula (2) or (3):

(2)

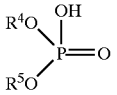

(3)

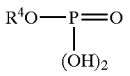

wherein $R^4$ and $R^5$, which may be the same or different, are each $C_{1-30}$-alkyl.

12. The lubricant composition as claimed in claim 11, wherein $R^4$ and $R^5$ are each methyl, ethyl, n-propyl, isopropyl, n-butyl, isobutyl, s-butyl, t-butyl and all isomers of pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, dococyl, tricosyl, tetracosyl, pentacosyl, hexacosyl, heptacosyl, octacosyl, nonacosyl, and triacontyl.

13. The lubricant composition as claimed in claim 1, wherein the amine component of the amine salt of the acid phosphate has the formula: $R^6_nNH_{3-n}$, wherein $R^6$, each of which may be the same or different, is a $C_{1-30}$-alkyl group and n is 1, 2 or 3.

14. The lubricant composition as claimed in claim 1, wherein the amine salt of the acid phosphate is present in an amount of 0.01 to 0.7% by weight.

15. The lubricant composition as claimed in claim 1, wherein the sulfur-containing extreme-pressure agent is sulfurized oils or fats, sulfurized fatty acids, sulfurized esters, sulfurized olefins, dihydrocarbyl polysulfides, thiocarbamates, thioterpenes, dialkylthio dipropionates and thiadiazoles.

16. The lubricant composition as claimed in claim 1, wherein the sulfur-containing extreme-pressure agent is present in an amount of 0.01 to 0.7% by weight.

17. The lubricant composition as claimed in claim 1, wherein the lubricant composition is stably effective as a lubricant at pressures of 30 Mpa and higher.

* * * * *